US007121703B2

(12) United States Patent
Strambersky et al.

(10) Patent No.: US 7,121,703 B2
(45) Date of Patent: Oct. 17, 2006

(54) MULTIFUNCTION ADAPTIVE PROJECTOR SYSTEM FOR MOTOR VEHICLES

(75) Inventors: Libor Strambersky, Senov u Noveho Jicina (CZ); Milan Cejnek, Novy Jicin (CZ); David Vozenilek, Kurim (CZ); Jaroslav Purma, Karvina (CZ)

(73) Assignee: Visteon Global Technologies, Inc., Van Buren Township, MI (US)

( * ) Notice: Subject to any disclaimer, the term of this patent is extended or adjusted under 35 U.S.C. 154(b) by 54 days.

(21) Appl. No.: 10/938,112

(22) Filed: Sep. 10, 2004

(65) Prior Publication Data

US 2005/0152154 A1 Jul. 14, 2005

(30) Foreign Application Priority Data

Sep. 10, 2003 (CZ) ..... 2003-2450

(51) Int. Cl.
*F21V 17/02* (2006.01)

(52) U.S. Cl. ..... 362/512; 362/282; 362/322; 362/539

(58) Field of Classification Search ..... 362/507, 362/465, 467–468, 319, 538–539, 282–284, 362/322–324, 512
See application file for complete search history.

(56) References Cited

U.S. PATENT DOCUMENTS

| | | | | |
|---|---|---|---|---|
| 4,857,794 | A * | 8/1989 | Watanabe | 313/113 |
| 5,331,520 | A | 7/1994 | Cejnek | |
| 5,574,328 | A | 11/1996 | Okuchi | |
| 5,660,454 | A | 8/1997 | Mori et al. | |
| 5,899,559 | A * | 5/1999 | Lachmayer et al. | 362/513 |
| 6,186,651 | B1 * | 2/2001 | Sayers et al. | 362/512 |
| 6,443,606 | B1 * | 9/2002 | Mochizuki | 362/513 |
| 6,488,396 | B1 * | 12/2002 | Hayakawa et al. | 362/539 |
| 6,641,291 | B1 * | 11/2003 | Yokoi et al. | 362/512 |
| 6,773,146 | B1 * | 8/2004 | Ishida | 362/460 |
| 2001/0040810 | A1 * | 11/2001 | Kusagaya | 362/351 |
| 2001/0043474 | A1 * | 11/2001 | Kusagaya | 362/466 |
| 2002/0186565 | A1 | 12/2002 | Taniuchi et al. | |
| 2003/0086277 | A1 * | 5/2003 | Hayakawa et al. | 362/513 |

FOREIGN PATENT DOCUMENTS

| | | |
|---|---|---|
| CZ | PV 1998-516 | 1/1999 |
| EP | 1 219 887 | 7/2002 |

* cited by examiner

*Primary Examiner*—Ali Alavi
(74) *Attorney, Agent, or Firm*—Brinks Hofer Gilson & Lione

(57) ABSTRACT

A multifunction adaptive projector system for motor vehicles is provided having a positioning mechanism designed to vary the position of a shield between three defined positions. The system includes an ellipsoidal reflector, a light source, a shield and a mechanism for variation of the position of the shield, in relation to the reflector, between a position for low beam light, a position for motorway light and a position for high beam light. For low beam light, the shield is in proximity of the focal point of the reflector. For motorway light, the shield is shifted by a first distance below the focal point of the reflector. For high beam light, the shield is shifted by a distance below the focal point of the reflector.

10 Claims, 2 Drawing Sheets

MULTIFUNCTION ADAPTIVE PROJECTOR SYSTEM FOR MOTOR VEHICLES

BACKGROUND

1. Field of the Invention

This invention relates to a multifunction adaptive projector system (headlamp) for motor vehicles. More specifically, a structure is provided whereby the position of the shield inside the projector lighting unit is variable to change the spatial distribution of light on the road. The shield can be positioned in three defined positions for generating high beam light (driving beam), motorway light and low beam light (passing beam).

2. Description of Related Technology

In order to generate low beam light and high beam light during use of a motor vehicle, prior art headlamps have typically been equipped with separate lighting units or combined lighting units utilizing two-filament light sources.

For motorway light, a beam pattern generally between low and high beam light, an additional lighting unit is needed. The main disadvantages of this additional lighting unit consist in higher demands for installation of this unit in the headlamp, use of an additional light source, higher power requirements and higher costs.

SUMMARY OF THE INVENTION

The above mentioned disadvantages have been eliminated and the optimization of an arrangement of low beam, high beam and motorway light modes of operation has been solved in accordance with this invention by means of a multifunction adaptive projector system or headlamp assembly. The system primarily includes a projector reflector, a light source, a shield, an aspherical lens and an adjustment mechanism, with two electromagnets and an elastomeric element, allowing movement of shield between three defined positions.

With the present invention, the pattern of the outgoing light beam can be changed by changing the position of shield relative to the reflector. Locating the shield in the area of the focal plane of the projector lighting unit has a consequence that part of light rays reflected from the projector reflector is shielded. With the present invention, this is used for the low beam function, when the shield creates a light-dark boundary and the light rays generating the hot spot present in the high beam function are shielded.

If the shield is partially shifted downward from the area of the focal plane of the projector lighting unit, then the light rays generating the hot spot present in the high beam function are partially unshielded. This generates a light-dark boundary for the motorway light mode of operation.

If the shield is fully shifted downward and removed substantially away from the focal plane of the projector lighting unit, then the light rays generating the hot spot in the high beam function are unshielded and the unit operates in the high beam light mode.

As mentioned above, the present multifunction adaptive projector system for motor vehicles includes a reflector having approximately an ellipsoidal shape, a light source, an aspherical lens and a mechanism designed for varying the position of shield between three defined positions relative to the ellipsoidal reflector. One solenoid or electromagnet is used in the mechanism for movement of shield for high beam light and another solenoid or electromagnet used for movement of shield for motorway light.

The light source is firmly arranged inside the ellipsoidal reflector in proximity to its optical axis so that the reference plane of the light source is at least perpendicular to this optical axis.

Electromagnet cores are arranged inside the electromagnets. These electromagnet cores are connected with rotational arms or levers coupled to the shield so that the axial movement of a core is transmitted to rotational or pivoting movement of arms and subsequently to mechanical movement of shield. The lengths of stroke of electromagnet cores are dependent on the geometrical arrangement of levers or arms of the mechanism.

An elastic deformable element is provided, arranged between a movable sleeve coupled to shield and the base of the mechanism. This elastic element is biased such that it provides the normal position of the shield as the position for low beam light function, when the cores are de-energized. This guarantees the position of the shield is the position for low beam light in case of any failure of the system.

The position of shield for low beam light is in proximity of the focal point of the reflector. In this position, none of the electromagnets are switched on and the shield is held in position by means of the deformable element.

The position of shield for motorway light is shifted by a distance $z_1$ mm below the focal point of the ellipsoidal reflector, when $$z_1=b_1\cdot\alpha+b_3\cdot\alpha^3+b_5\cdot\alpha^5+b_7\cdot\alpha^7+\ldots,\ \text{for}\ \alpha\approx(0\ \text{to}\ 3),$$

where $b_{1,3,5,7,\ldots}$ are constant representing the focal area of characterizing the aspherical lens and $\alpha$ is a angle between the low beam cut-off (the boundary line between the light and dark area) and a horizontal plane. This movement is carried out by the core of the electromagnet for motorway light.

For high beam light, the position of shield is shifted, by the distance $z_2$ mm, below the focal point of the ellipsoidal reflector, when $z_2>z_1$. This change of position of shield is attained by movement of the core of a separate electromagnet for high beam light.

Conveniently, the change in the position of the shield for motorway light mode of operation is carried out by two solenoids or electromagnets, one electromagnet for the motorway light mode of operation, and the change in position of the shield for high beam light is carried out by a separate electromagnet for the high beam light.

For final adjustment of the unit at the time of installation or otherwise, the whole multifunction adaptive projector system can be further vertically adjusted by manual or other means.

The light source is advantageously a xenon light source or a halogen light source.

BRIEF DESCRIPTION OF THE DRAWINGS

The preferred, but not limiting, embodiment of the present invention is described below with reference to the accompanying drawings, in which.

DETAILED DESCRIPTION

Figure 1:
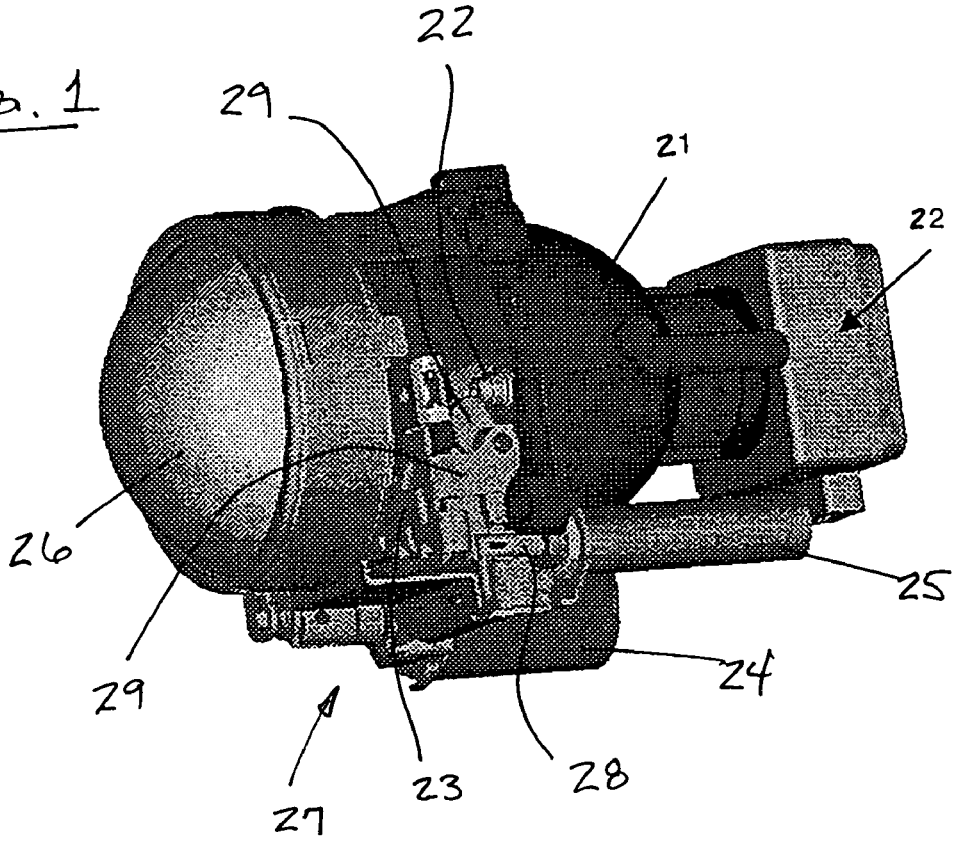
FIG. 1 shows a multifunction adaptive projector system according to the principles of the present invention.
Figure 2:
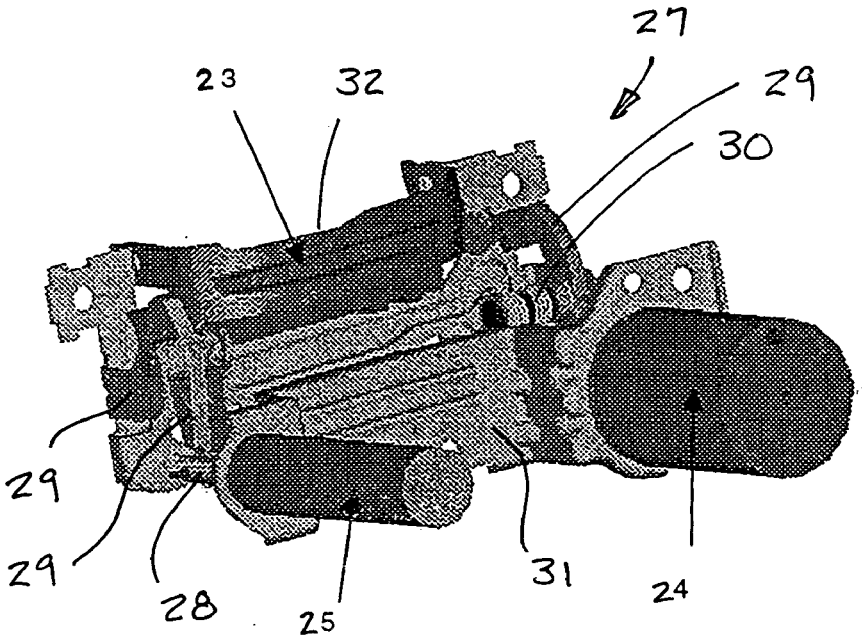
FIG. 2 illustrates the location of electromagnets in the system of FIG. 1.

Illustrated in the perspective view of FIG. 1 is a multifunction adaptive projector system embodying the principles of the present invention and generally designated at 10. As its primary components, the projector assembly 10 includes an ellipsoidal reflector 21, a light source 22, an aspherical lens 26 and a mechanism 27 for variation the position of a shield 23 for three different positions. Changing the operational mode of the projector assembly 10 for low beam light, high beam light and motorway light is made by changing the position of the shield 23 relative to the ellipsoidal reflector 21.

The light source 22 is firmly and conventionally arranged inside the ellipsoidal reflector 21 in the proximity of its optical axis 27. Accordingly, the reference plane of the light source 22 is generally perpendicular to the optical axis 27.

One solenoid or electromagnet 24 for high beam light and an electromagnet 25 for motorway light are used in order to provide this movement of the shield 23. To vary the position of the shield 23, electromagnets 24 and 25 are used as the sources of mechanical power.

The electromagnets 24 and 25 are of common construction and include electromagnet cores (not shown) arranged inside. These electromagnet cores are connected via an actuation shaft 28 to rotational arms or levers 29, coupled to the shield 23, so that axial movement of the cores is transformed into rotational movement of arms and subsequently to mechanical movement of the shield 23. The lengths of stroke of the electromagnet cores are dependent on the geometrical arrangement of their actuation shaft and lever mechanism, including the levers and arms 29. An elastic deformable element 30, such as a spring or elastomeric member, is arranged between the movable shield 23 and a base 31 of the mechanism 27. The deformable element 30 exhibits a bias such that upon de-energizing of either (or both) of the electromagnets 24 and 25, the shield 23 is moved back to its normal position, the operational position, relative to the light source 2, for low beam light function. In the illustrated embodiment the deformable element 30 is located between the base 31 and the arms or levers 29 associated with the electromagnet 24 and causes rotation of the arms or levers 29, and therefore movement of the shield 23.

Figure 3A:
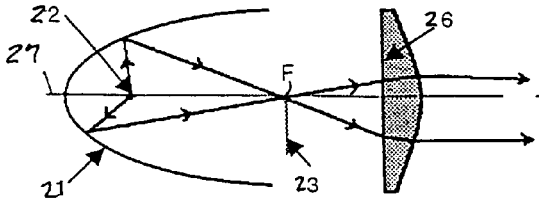
FIGS. 3*a*, 3*b*, 4*a*, 4*b*, 5*a* and 5*b* show the positions of the shield and the outgoing shape of the light beam for low beam, motorway and high beam light operational modes, respectively.
Figure 3B:
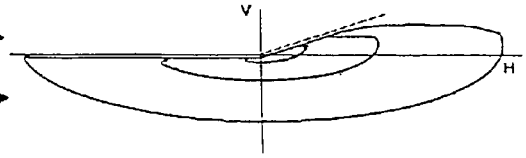

As illustrated in FIG. 3*a*, the position of shield 23 for low beam light is such that the shield 22 or the top edge 32 of the shield 23 is in proximity or adjacent to the focal point F of the ellipsoidal reflector 21. In this position, neither of the electromagnets 24 and 25 is switched on and the shield 23 is held by means of the deformable element 30. The low beam light pattern is illustrated in FIG. 3*b*.

Figure 4A:
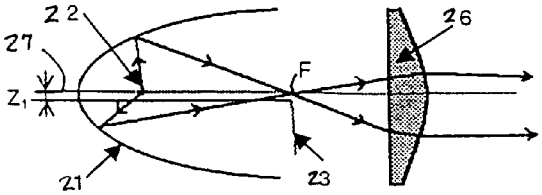
Figure 4B:
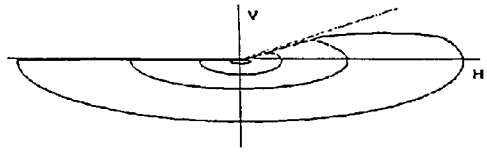
Figure 5A:
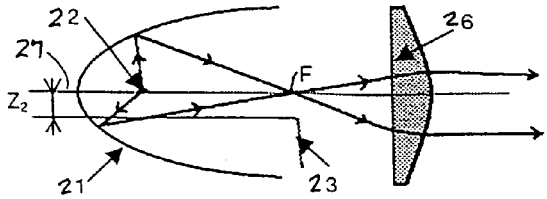
Figure 5B:
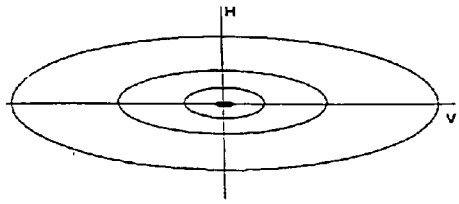

As seen in FIG. 4*a*, the position of shield 23 for motorway light is shifted by distance $z_1$ mm downward relative to the optical axis 27 and ground, below the focal point F of the reflector 21, when $$z_1=b_1\cdot\alpha+b_3\cdot\alpha^3+b_5\cdot\alpha^5+b_7\cdot\alpha^7+\ldots,\ \text{for}\ \alpha\approx(0\ \text{to}\ 3),$$

where $b_{1,3,5,7,\ldots}$ are constants characterizing the aspherical lens 26, more specifically the mathematical constants in polynominal which represents the focal area of the lens, and where $\alpha$ is the angle between the beam cut-off (bounding line between light and dark areas) and a horizontal plane. This movement is carried out by the electromagnet 25 and results in the beam pattern seen in FIG. 4*b*. Upon movement of the electromagnet's core, the actuation arms or levers 29 are caused to be rotated thereby resulting in movement of the shield 23. For the high beam light mode of operation (as seen in FIG. 5*a*), the position of shield 23 is shifted by distance $z_2$ mm below the focal point F of the reflector 1, when $z_2>z_1$. This change of position of shield 23 for the high beam light mode of operation is attained by movement of the core in electromagnet 24, resulting in the beam pattern seen in FIG. 5*b*. Upon movement of the electromagnet's core, the actuation arms or levers 29 are caused to be rotated thereby resulting in movement of the shield 23.

For final adjustment of the unit at the time of installation or otherwise, the whole multifunction adaptive projector system can be further vertically adjusted by manual or other means.

The invention claimed is:

1. A multifunction adaptive projector system for motor vehicles comprising an ellipsoidal reflector having a focal point and an optical axis;

a light source;

a shield; and a mechanism for variation of the position of said shield in relation to said reflector between a position for low beam light, a position for motorway light and a position for high beam light, an aspherical lens, in said position for low beam light said shield being in proximity of said focal point in said position for motorway light said shield being shifted by a first distance below said focal point when $$z_1=b_1\cdot\alpha+b_3\cdot\alpha^3+b_5\cdot\alpha^5+b_7\cdot\alpha^7+\ldots,\ \text{for}\ \alpha\approx(0\ \text{to}\ 3),$$

where $b_{1,3,5,7,\ldots}$ are constants characterizing said aspherical lens; and in a position for high beam light said shield being shifted by a second distance below said focal point of said reflector, said second distance being greater than said first distance.

2. The multifunction adaptive projector system for motor vehicles according to claim 1, further comprising an electromagnet for motorway light and an electromagnet for high beam light, said electromagnet for motorway light being operable to move said shield to said position for motorway light and said electromagnet for high beam light being operable to move said shield to said position for high beam light.

3. The multifunction adaptive projector system for motor vehicles according to claim 1 wherein said position for motorway light is measured perpendicular to said optical axis.

4. The multifunction adaptive projector system for motor vehicles according to claim 3 wherein said position for motorway light is vertically aligned with said focal point.

5. The multifunction adaptive projector system for motor vehicles according to claim 1 wherein said position for high beam light is measured perpendicular to said optical axis.

6. The multifunction adaptive projector system for motor vehicles according to claim 1 wherein said position for high beam light is vertically aligned with said focal point.

7. The multifunction adaptive projector system for motor vehicles according to claim 1 wherein said mechanism for variation of the position of said shield includes an elastic deformable element coupling said shield to said reflector and having a bias adapted to automatically return the position of said shield to said position for low beam light.

8. The multifunction adaptive projector system for motor vehicles according to claim 1 wherein said light source is a xenon light source.

9. The multifunction adaptive projector system for motor vehicles according to claim 1 wherein said light source is a halogen light source.

10. A headlamp assembly comprising:

a reflector having a generally concave surface, an optical axis extending therefrom and defining a focal point;

a light source mounted within a concavity defined by said concave surface and being located generally along said optical axis;

a shield mounted in front of said light source relative to said optic axis, said shield being moveable mounted and having a low beam light position, a motorway light position and a high beam light position, in said low beam light position said shield being located such that said shield is in proximity to said focal point, in said motorway light position said shield being located a first distance away from said optical axis, in said high beam light position said shield being located a second distance away from said optical axis, said second distance being greater than said first distance.

* * * * *